US005681679A

United States Patent [19]

Schank et al.

[11] Patent Number: 5,681,679

[45] Date of Patent: Oct. 28, 1997

[54] OVERCOATED ELECTROPHOTOGRAPHIC IMAGING MEMBER WITH RESILIENT CHARGE TRANSPORT LAYER

[75] Inventors: Richard L. Schank, Pittsford; William W. Limburg, Penfield; Damodar M. Pai, Fairport; John F. Yanus; Dale S. Renfer, both of Webster; Paul J. DeFeo, Sodus Point; Merlin E. Scharfe, Penfield, all of N.Y.

[73] Assignee: Xerox Corporation, Stamford, Conn.

[21] Appl. No.: 721,811

[22] Filed: Sep. 27, 1996

[51] Int. Cl.[6] ..... G03G 5/047; G03G 5/14

[52] U.S. Cl. ..... 430/59; 430/66; 430/83

[58] Field of Search ..... 430/59, 66, 83

[56] References Cited

U.S. PATENT DOCUMENTS

| | | | |
|---|---|---|---|
| 4,621,009 | 11/1986 | Lad | 428/216 |
| 4,983,481 | 1/1991 | Yu | 430/59 |
| 5,167,987 | 12/1992 | Yu | 427/171 |
| 5,230,976 | 7/1993 | Schaak et al. | 430/59 |
| 5,368,967 | 11/1994 | Schank et al. | 430/59 |
| 5,436,099 | 7/1995 | Schank et al. | 430/66 |

*Primary Examiner*—Roland Martin

[57] ABSTRACT

A flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

17 Claims, No Drawings

OVERCOATED ELECTROPHOTOGRAPHIC IMAGING MEMBER WITH RESILIENT CHARGE TRANSPORT LAYER

BACKGROUND OF THE INVENTION

This invention relates in general to electrostatography and, more specifically, to an electrostatographic imaging member having a resilient charge transport layer and a crosslinked overcoating.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive materials exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous dispersions of conductive material in binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more electrically active layers are applied to a flexible supporting substrate, it has been found that the resulting photoconductive member tends to curl. Curling is undesirable because different segments of the imaging surface of the photoconductive member are located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. An imaging member having a tendency to curl can spontaneously form a roll as small as 3.8 cm in diameter and requires considerable tension to flatten the imaging member against the surface of a separate supporting device. Where the supporting device comprises a large flat area for full frame flash exposure, the imaging member may tear before sufficient flatness can be achieved. Moreover, constant flexing of multilayered photoreceptor belts during cycling can cause stress cracks to form due to fatigue. These cracks print out on the final electrophotographic copy. Premature failure due to fatigue prohibits use of these belts in designs utilizing small roller sizes (e.g. 19 mm or smaller) for effective auto paper stripping. Coatings may be applied to the side of the supporting substrate opposite the electrically active layer or layers to counteract the tendency to curl. However, such coating requires an additional coating step on a side of the substrate opposite from the side where all the other coatings are applied. This additional coating operation normally requires that a substrate web be unrolled an additional time merely to apply the anticurl layer. Also, many of the solvents utilized to apply the anticurl layer require additional steps and solvent recovery equipment to minimize solvent pollution of the atmosphere. Further, equipment required to apply the anti-curl coating must be cleaned with solvent and refurbished from time to time. The additional coating operations raise the cost of the photoreceptor, increase manufacturing time, decrease production throughput, and increases the likelihood that the photoreceptor will be damaged by the additional handling. In addition, the anti-curl backing layer can form bubbles during application which requires scrapping of that portion of the photoreceptor containing the bubbles. This in turn reduces total manufacturing yield. Also, difficulties have been encountered with these anti-curl coatings. For example, photoreceptor curl can sometimes still be encountered due to a decrease in anticurl layer thickness resulting from wear in as few as 1,500 imaging cycles when the photoreceptor belt is exposed to stressful operating conditions of high temperature and high humidity. The curling of the photoreceptor is inherently caused by internal stress build-up in the electrically active layer or layers of the photoreceptor which promotes dynamic fatigue cracking, thereby shortening the mechanical life of the photoreceptor. Further, the anticurl coatings occasionally separate from the substrate during extended machine cycling and render the photoconductive imaging member unacceptable for forming quality images. Anticurl layers will also occasionally delaminate due to poor adhesion to the supporting substrate. Moreover, in electrostatographic imaging systems where transparency of the substrate and anticurl layer are necessary for rear exposure erase to activating electromagnetic radiation, any reduction of transparency due to the presence of an anticurl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

Further, the anticurl coating introduces mechanical stresses which, when perturbed by wear, results in distortions which resemble ripples. These ripples are the most serious photoreceptor related problem in advanced precision imaging machines that demand precise tolerances. When ripples are present, different segments of the imaging surface of the photoconductive member are located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. It is theorized that since the anticurl backing layer is usually composed of material that is less wear resistant than the adjacent substrate layer, it wears rapidly during extended image cycling, particularly when supported by stationary skid plates. This wear is nonuniform and leads to the distortions which resemble ripples and also produces debris which can form undesirable deposits on sensitive optics, corotron wires and the like.

Another key limitation of photoreceptors is the inability to easily transfer developed toner particles to paper or other media due to non optimal surface energy properties, inadequate resiliency properties of the entire device and the limited layer thickness of practical photoreceptor devices. Poor transfer is particularly a problem for small toners of the order of one micrometer or less for both dry and liquid toner systems. Small toners are required for high quality production color reproductions. Generally, photoreceptors cannot mechanically conform to the paper thereby making the transfer of these small toners very inefficient. The small toners generally have strong adhesive forces that attach them to the photoreceptor which makes them difficult to transfer unless intimate contact is made with the paper or substrate to which transfer is to occur. This is particularly an important problem for color systems where slight changes in transfer can cause color shifts in the final image. The lack of "resiliency" also impacts larger size toners greater than one micrometer in diameter since enhanced contact aided by resiliency increases the transfer efficiency of toners of all sizes. This would be particularly helpful in systems where some distribution in toner sizes exists for larger size toner systems. Also, photoreceptors are usually limited in capability to provide heat to the toner during transfer in both liquid and dry toner development systems. Capability to provide some heat through the photoreceptor would give the toner a boost in temperature which could reduce fuser temperature requirements which, in turn, would increase the fuser life. The temperature boost could also be used to modify the resiliency properties of the devices utilized during transfer thereby further improving the transfer properties.

In imaging systems that utilize photoconductor imaging devices of the present art and which utilize liquid developers or small diameter dry toner particles having an average particle size of less than about 1 micrometer, poor quality copies are achieved when the toner image is transferred from a photoreceptor to a receiving member having large asperities on the surface that receives the toner image. This is because large asperities on the receiving surface of receiving members such as rough paper prevent uniform contact of the entire toner image with the adjacent surface of the receiving member. Asperities in the range of 20 to 80 micrometers can cause nonuniform cantact. Since contact is essential for transfer, some of the toner image is not transferred and the resulting transferred toner image exhibits undesirable deletion characteristics. Although high pressure could be applied to press paper sheets against a photoreceptor to help flatten asperities, such pressure can damage the photoreceptor and even punch holes in the sensitive charge generating layer. Moreover, such pressure causes toner to form deposits of impacted toner which appear as toner streaks or films which adversely affect the formation of subsequent images on the photoreceptor during image cycling. Thus, background on copies begin to degrade. This impaction problem is aggravated by low $T_g$ toners needed for high speed copiers, duplicators and printers, particularly color systems. All of these problems are intensified when thermal energy is employed to assist toner image transfer.

Pressure also increases abrasive wear of the photoreceptor. Increased wear (and therefore the reduced photoreceptor thickness) alters the electrical properties of the photoreceptor. For example sensitivity declines and higher and higher electrical fields are required for imaging. Higher fields lead to localized image defects such as charge deficient spots. To avoid this problem, intermediate transfer members having a smooth outer surface and made of a resilient material are employed to remove toner images from a photoreceptor. After transfer from the photoreceptor to the intermediate transfer member, higher pressures can be used to transfer toner images from the intermediate transfer member to a receiving member such as paper. However, this approach increases the complexity and cost of an imaging system and also reduces imaging speed.

When liquid developers are utilized to develop photoreceptors of the current art, the conventional hydrocarbon carrier fluid of the inks tends to leach out electrically active small molecules from the charge transport layer and degrade the electrical properties of the photoreceptor. In addition some hole transporting polymers are physically attacked by the hydrocarbon carrier fluid.

A number of polymers charge transport systems such as those described in U.S. Pat. No. 5,230,976 could be fabricated to meet the improved resiliency requirements. Also, these could be made quite thick (around 100 micrometers) which would enable larger surface variations in the papers in the paper or substrate. Generally, however, these materials have very poor wear properties or not robust against corona or liquid ink systems. In these cases an overcoat which exhibits good corona and solvent protection could enable the use of a less durable, thick polymer charge transport systems with good resiliency properties. It would be desirable to have an transport layer/overcoat layer combination with each layer "tuned" for optimal surface, resiliency and wear properties to enable the improved transfer and system properties.

INFORMATION DISCLOSURE STATEMENT

U.S. Pat. No. 5,230,976 to Schank, issued Jul. 27, 1993—A polymeric arylamine siloxane compound is disclosed represented by the formula:

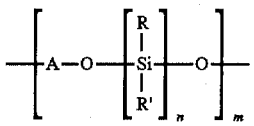

wherein A is a tertiary arylamine moiety, R is a substituted or unsubstituted alkyl, alkenyl or aryl group, R' is a substituted or unsubstituted alkyl, alkenyl or aryl group, m is an integer from about 5 to about 5,000, and n is an integer from 1 to 6 (preferably from 1 to 3). The tertiary arylamine moiety is derived from and is a residue of a precursor tertiary arylamine compound used in the reaction forming the polymer. This polymer may be used in charge transport layers.

U.S. Pat. No. 5,167,987 to Yu, issued—A process for fabricating an electrostatographic imaging member is disclosed comprising providing a flexible substrate comprising a solid thermoplastic polymer, forming an imaging layer coating comprising a film forming polymer on the substrate, heating the coating, cooling the coating, and applying sufficient predetermined biaxial tensions to the substrate while the imaging layer coating is at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of stress and strain.

U.S. Pat. No. 4,983,481 to Yu, issued Jan. 8, 1991—An imaging member without an anti-curl layer is disclosed having improved resistance to curling. The imaging member comprises a flexible supporting substrate layer, an electrically conductive layer, an optional adhesive layer, a charge generator layer and a charge transport layer, the supporting layer having a thermal contraction coefficient substantially identical to the thermal contraction coefficient of the charge transport layer.

U.S. Pat. No. 4,621,009 to Lad, issued Nov. 4, 1986—A coating composition is disclosed for application onto a plastic film to form a coating capable of bonding with xerographic toner. The coating composition consists of a resin binder, preferably a polyester resin, a solvent for the resin binder, filler particles, and at least one crosslinking and antistatic agent. The coating composition is applied to a polyester film, preferably a film of polyethylene terephthalate, under conditions sufficient to fix toner onto the coating without wrinkling.

CROSS REFERENCE TO RELATED APPLICATIONS

This application is related to the following US-A Patent Applications:

U.S. patent application Ser. No. 08/721,812 filed Sep. 27, 1996 in the names of R. Schank et ah, entitled "COMPOSITIONS AND PHOTORECEPTOR OVERCOATINGS CONTAINING A DIHYDROXY ARYLAMINE AND A CROSSLINKED POLYAMIDE"—An electrophotographic imaging member is disclosed including including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. patent application Ser. No. 08/722,759 filed Sep. 27, 1996 in the names of A. Ward et el., entitled "PROCESS FOR FABRICATING AN ELECTROPHOTOGRAPHIC IMAGING MEMBER"—A process is disclosed for fabricating an electrophotographic imaging member including providing a substrate coated with at least one photoconductive layer, applying a coating composition to the photoconductive layer by dip coating to form a wet layer, the coating composition including finely divided silica particles, a dihydroxy amine charge transport material, an aryl charge transport material that is different from the dihydroxy amine charge transport material, a crosslinkable polyamide containing methoxy groups attached to amide nitrogen atoms, a crosslinking catalyst, and at least one solvent for the hydroxy amine charge transport material, aryl charge transport material and the crosslinkable polyamide, and heating the wet layer to crosslink the polyamide and remove the solvent to form a dry layer in which the dihydroxy amine charge transport material and the aryl charge transport material that is different from the dihydroxy amine charge transport material are molecularly dispersed in a crosslinked polyamide matrix.

U.S. patent application Ser. No. 08/722,347 (filed Sep. 27, 1996 in the names of et el., entitled "HIGH SPEED ELECTROPHOTOGRAPHIC IMAGING MEMBER"—An electrophotographic imaging member is disclosed including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. patent application Ser. No. 08/722,352 filed Sep. 27, 1996 in the names of et al., entitled "ELECTROPHOTOGRAPHIC IMAGING MEMBER HAVING AN IMPROVED CHARGE TRANSPORT LAYER"—A flexible electrophotographic imaging member including a supporting substrate coated with at least one imaging layer comprising hole transporting material containing at least two long chain alkyl carboxylate groups dissolved or molecularly dispersed in a film forming binder.

Thus, the characteristics of many electrostatographic imaging members comprising a supporting substrate coated on one side with at least one photoconductive layer and coated or uncoated on the other side with an anticurl layer exhibit deficiencies which are undesirable in automatic, cyclic electrostatographic copiers, duplicators, and printers. Other undesirable characteristics described above include inadequate transfer to receiving members having large asperities on the outer receiving surface thereof.

SUMMARY OF THE INVENTION

It is an object of the invention to provide an electrostatographic imaging member which overcomes the above-noted disadvantages.

It is still another object of this invention to provide an electrostatographic imaging member with improved resistance to curling.

It is yet another object of this invention to provide an electrostatographic imaging member which is less complex.

It is another object of this invention to provide an electrostatographic imaging member capable of being fabricated with a simpler coating process.

It is still another object of this invention to provide an electrostatographic imaging member free of an anticurl backing layer.

It is yet another object of this invention to provide an electrostatographic imaging member having improved resistance to the formation of ripples when subjected to extended image cycling.

It is an another object of this invention to provide an electrostatographic imaging member with improved resistance to abrasion.

It is still another object of this invention to provide an electrostatographic imaging member having improved thermal resistance.

It is yet another object of this invention to provide an electrostatographic imaging member which conforms to the asperities of receiving members such as ordinary paper.

It is still another object of this invention to provide an electrostatographic imaging member which is resilient and exhibits restoration to its original topographical form after a toner image has been transferred and a receiving member is separated from the imaging member.

It is another object of this invention to provide an electrostatographic imaging member having a thick transport layer that is not limited by charge carrier mobilities.

It is yet another object of this invention to provide an electrostatographic imaging member having a thick transport layer as thick as 100 micrometers thick which enables transfer to the surface of receiving substrates having 80 micrometer asperities.

It is still another object of this invention to provide an electrostatographic imaging member in which the properties of the transport layer and the overcoat layer are tuned for optimal surface resiliency and wear properties.

It is another object of this invention to provide an electrostatographic imaging member in which heat can be provided to the toner pile through the photoconductor during the development step in order to reduce fuser temperature and increase fuser life.

It is yet an another object of this invention to provide an electrostatographic imaging member with improved resistance to liquid ink vehicles, particularly at high thermal transfer temperatures.

It is still another object of this invention to provide an electrostatographic imaging member exhibiting an increased cycling life.

The foregoing objects and others are accomplished in accordance with this invention by providing a flexible electrophotographic imaging member comprising a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process comprising forming an electrostatic latent image on the imaging member, depositing toner particles on the imaging member in conformance with the latent image to form a toner image, and transferring the toner image to a receiving member.

The term "substrate" is defined herein as a flexible member comprising a solid thermoplastic polymer that is uncoated or coated on the side to which a charge generating layer and a charge transport layer are to be applied and free of any anticurl backing layer on the opposite side.

The expression "at least one photoconductive layer" is defined herein as a single photoconductive layer or a photoconductive layer comprising a charge generating layer and a separate charge transport layer. In the embodiment where the photoconductive layer comprises a single photoconductive layer, the single photoconductive layer contains the resilient hole transporting arylamine siloxane polymer. In the embodiment where the photoconductive layer comprises a charge generating layer and a separate charge transport layer, the charge transport layer contains the resilient hole transporting arylamine siloxane polymer.

Preferably, the imaging member comprises a flexible supporting substrate having an electrically conductive surface and at least one imaging layer. The flexible supporting substrate layer having an electrically conductive surface may comprise any suitable flexible web or sheet comprising a solid thermoplastic polymer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient mechanical strength to support the electrophotoconductive layer or layers. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, copper iodide, carbon black, graphite and the like dispersed in the solid thermoplastic polymer. The flexible conductive layer may vary in thickness over substantially wide ranges depending on the desired use of the electrophotoconductive member. Accordingly, the conductive layer can generally range in thicknesses of from about 50 Angstrom units to about 1 50 micrometers. When a highly flexible photoresponsive imaging device is desired, the thickness of the conductive layer may be between about 100 Angstrom units to about 750 Angstrom units. Any suitable underlying flexible support layer of any suitable material containing a thermoplastic film forming polymer alone or a thermoplastic film forming polymer in combination with other materials may be used. Typical underlying flexible support layers comprise film forming polymers include, for example, polyethylene terepthalate, polyimide, polysulfone, polyethylene naphthalate, polypropylene, nylon, polyester, polycarbonate, polyvinyl fluoride, polystyrene and the like. Specific examples of supporting substrates include polyethersulfone (Stabar S-100, available from from ICI), polyvinyl fluoride (Tedlar, available from E. I. DuPont de Nemours & Company), polybisphenol-A polycarbonate (Makrofol, available from Mobay Chemical Company) and amorphous polyethylene terephthalate (Melinar, available from ICI Americas, Inc.).

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available biaxially oriented polyethylene terephthalate substrate known as Melinex 442, available from ICI. If desired, the substrate may be a rigid drum.

Optionally, any suitable charge blocking layer may be interposed between the conductive layer and the photogenerating layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because its cyclic stability is extended. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino) propyl triethoxysilane, N,N-dimethylaminophenyltriethoxy silane, trimethoxysilylpropyldiethylenetriamine and mixtures thereof.

Generally, satisfactory results may be achieved when the reaction product of a hydrolyzed silane and metal oxide layer forms a blocking layer having a thickness between about 20 Angstroms and about 2,000 Angstroms.

In some cases, intermediate layers between the blocking layer and the adjacent charge generating or photogenerating layer may be desired to improve adhesion or to act as an electrical barrier layer. If such layers are utilized, they preferably have a dry thickness between abut 0.01 micrometer to about 5 micrometers. Typical adhesive layers include film forming polymers such as polyester, polyvinylbutyral, polyvinylpyrolidone, polyurethane, polymethyl methacrylate and the like.

Generally, the electrophotoconductive imaging member of this invention comprises a supporting substrate layer, a metallic conductive layer, a charge blocking layer, an optional adhesive layer, a charge generator layer, a charge transport layer. The electrophotoconductive imaging member of this invention can be free of any anti-curl layer on the side of the substrate layer opposite at least one photoconductive layer and an overcoat. If desired, a back coating to enhance tracking or enhance abrasion resistance may be present. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. Nos. 4,489,143, 4,507,480, U.S. Pat. Nos. 4,306,008, 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is important that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The relatively thick active charge transport layer, in general, comprises a polymeric siloxyarylamine hole transporting material represented by the formula:

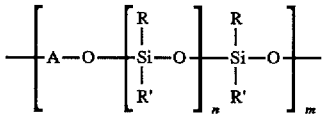

wherein:

A is a tertiary arylamine moiety,

R is a substituted or unsubstituted alkyl, alkenyl or aryl group,

R' is a substituted or unsubstituted alkyl, alkenyl or aryl group, m is an integer from about 5 to about 5,000, and n is an integer from 1 to 6 (preferably from 1 to 3).

The tertiary arylamine moiety A is derived from and is a residue of a precursor tertiary arylamine compound used in the reaction forming the polymer. Preferably, the tertiary arylamine moiety is represented by the formula:

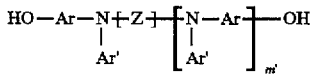

wherein:

m' is 0 or 1,

Z is selected from the group consisting of:

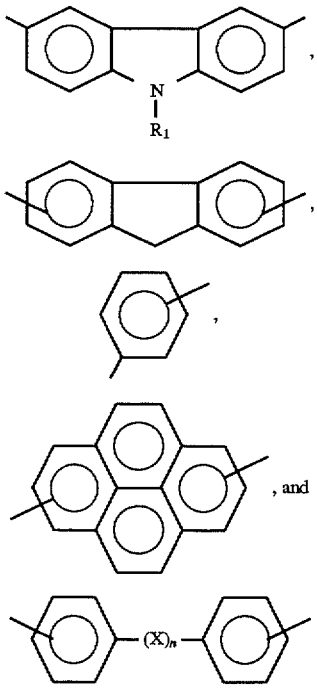

n is 0 or 1,

Ar is selected from the group consisting of:

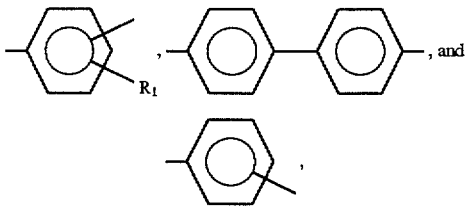

$R_1$ is selected from the group consisting of $—CH_3$, $—C_2H_5$, $—C_3H_7$, and $—C_4H_9$, Ar' is selected from the group consisting of:

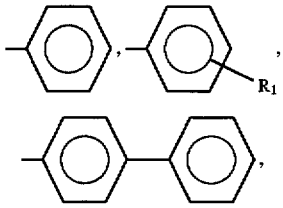

X is selected from the group consisting of:

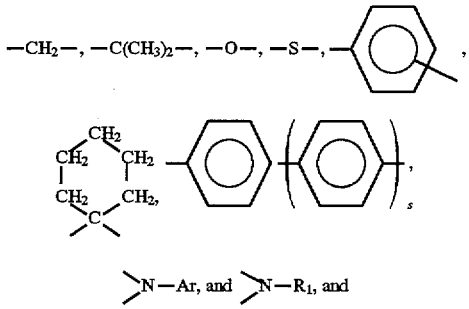

s is 0,1 or 2.

The substituted or unsubstituted alkyl, alkenyl groups represented by R and R' may contain from 1 to 2 carbon atoms.

Generally, the hydroxy arylamine compounds are prepared, for example, by hydrolyzing a dialkoxy arylamine. A typical process for preparing alkoxy arylamines is disclosed in Example I of U.S. Pat. No. 4,588,666 to Stolka et al, the entire disclosure of this patent being incorporated herein by reference.

Typical hydroxy arylamine compounds of this invention include, for example:

N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxpyphenyl)-aminophenyl]-cyclohexane; 1,1-bis[4-(N-m-hydroxyphenyl)-4-(N-phenyl)-aminophenyl]-cyclohexane; Bis-(N-(3-hydroxyphenyl)-N-phenyl-4-aminophenyl)-methane; Bis[(N-(3-hydroxyphenyl)-N-phenyl)-4-aminophenyl]-isopropylidene; N,N'-diphenyl-N,N'-bis(3-hydroxyphenyl)-[1,1':4', 1"-terphenyl]-4,4"-diamine; 9-ethyl-3,6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; 1,4-bis[N-phenyl-N-(3-hydroxyphenyl)]-phenylenediamine. N,N'-diphenyl-N-N'-bis(4-hydroxy phenyl)[1,1'-biphenyl]-4,4'-diamine N,N,N',N',-tetra(4-hydroxyphenyl)-[1,1'-biphenyl]-4,4'-diamine; N,N-di(4-hydroxyphenyl)-m-toluidine; 1,1-bis-[4-(di-N,N-p-hydroxpyphenyl)-aminophenyl]-cyclohexane; 1,1-bis[4-(N-o-hydroxyphenyl)-4-(N-phenyl)-aminophenyl]-cyclohexane; Bis-(N-(4-hydroxyphenyl)-N-phenyl-4-aminophenyl)-methane; Bis[(N-(4-hydroxyphenyl)-N-phenyl)-4-aminophenyl]-isopropylidene; Bis-N,N-[(4'-hydroxy-4-(1,1'-biphenyl)]-aniline Bis-N,N-[(2'-hydroxy-4-(1,1'-biphenyl)]-aniline Especially preferred compounds of the present invention are those of the formula:

Formula 1

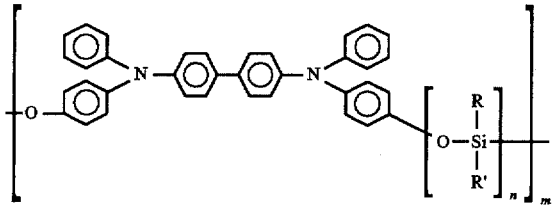

wherein R, R', m and n are as specified above. Other such compounds according to the present invention are of similar formula but with substitution on the tertiary arylamine moiety resulting from the use of an arylamine other than N,N'-diphenyl-N,N'-bis(3-hydroxyphenyl)-(1-1'-biphenyl)-4,4'-diamine to make such compounds.

Some of the foregoing objects and others are also accomplished in accordance with the present invention by providing a polymeric arylamine siloxane compound formed by the reaction of a tertiary aryl amine, such as N,N'-diphenyl-N,N'-bis(3-hydroxyphenyl)-(1-1'-biphenyl)-4,4'-diamine and the like, with a silane, if x=0 or a siloxane of the general formula:

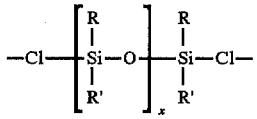

wherein R is a substituted or unsubstituted alkyl, alkenyl or aryl group, R' is a substituted or unsubstituted alkyl, alkenyl or aryl group, and n is an integer from 0 to 6 (preferably from 0 to 3). Mixtures of two or more siloxanes, a silane when x=0, of this formula may also be reacted with the arylamine compound to form compounds of the present invention. The arylamine compound and siloxanes, a silane when x=0, can also be reacted in the presence of additional aromatic monomers, such as bisphenols and the like.

The active charge transport layer comprising the siloxyarylamine polymer should be capable of supporting the injection of photogenerated holes from the charge generation layer and allowing the transport of these holes through the transport layer to selectively discharge the surface charge. The charge transport layer should exhibit negligible, if any, discharge when exposed to a wavelength of light useful in xerography (e.g. 4000 angstroms to 9000 angstroms). Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate will all light passing through the substrate. In this case, the active transport material need not be transmitting in the wavelength region of use. The charge transport layer in conjunction with the generation layer forms a combination which is an insulator to the extent that an electrostatic charge placed on the transport layer is not conducted in the absence of illumination.

Part or all of the transport material comprising conventional hole transporting small molecule in an inactive binder employed in transport layers may be replaced by the active siloxyarylamine polymer material described above. Any polymeric arylamine moieties should be free from electron withdrawing substituents such as $NO_2$ groups, CN groups, >C=0 and the like. The hole transporting small molecule-inactive resin binder composition may be entirely replaced with 100 percent of a polymeric arylamine compound of this invention. The charge transport layer should contain at least about 50 percent by weight of the siloxyarylamine polymer material based on the total weight of the layer. To achieve sufficient charge transport layer resiliency for optimum transfer of toner images to receiving members having large asperities on the receiving member surface, the transport layer preferably contains between about 50 percent and about 100 percent by weight of the siloxyarylamine polymer material based on the total weight of the layer.

Any suitable solvent may be employed to apply the transport layer material to the underlying layer. Typical solvents include methylene chloride, toluene, tetrahydrofuran, and the like. Toluene solvent is a particularly desirable component of the charge transport layer coating mixture for adequate dissolving of all the components.

Generally, difficulties in achieving high levels of transfer of a toner image are encountered when portions of the image fail to make intimate contact with the receiving member. Asperities at least large as between about 20 micrometers and about 80 micrometers can cause this poor contact. Those portions not in intimate contact are then not subject to the adhesive force generated between the toner and the receiving member surface and thus may fail to transfer. One contributing factor to the generation of the adhesive force between the toner and receiving member is related to the photoreceptor being heated, which in turn heats the toner image. The receiving material entering the transfer zone is at a lower temperature than the toner image material. The hot toner material is somewhat fluid and when intimate contact with the cooler receiving member is made the toner is cooled sufficiently to become more solid and adhere to the receiving member, thus transferring. Those portions not in intimate contact fail to cool and thus often fail to transfer. This leads to degradation in the quality of the transferred image.

The expression "resiliency" as employed herein is defined as sufficient to endure the stress induced by the asperities during the application of pressure and temperature during the image transfer process. The stress sensitive generator layer must maintain its integrity and the photoreceptor device must return to its original shape after being removed from the pressure and temperature of the transfer zone. The temperature can reach to about 100 degree C and the pressure can be up to about 250 lbs/in$^2$. The temperature and pressure required to achieve image transfer is dependent on receiving member smoothness, $T_g$ of the toner being used and conformability of the photoreceptor surface. A measure of conformability is durometer and for the photoreceptor device of this invention the durometer should be about 65 or less at the operating temperature. The thickness of the conformable portion of the photoreceptor must be able to absorb the asperities of the receiving member. Generally, the thickness of the hole transport layer is between about 5 and about 100 micrometers but thicknesses outside this range can also be used. However, to achieve sufficient charge transport layer resiliency for optimum transfer of toner images to receiving members having large asperities on the receiving member surface, the transport layer preferably has a thickness between about 50 micrometers and about 100 micrometers. Preferably, the combined thickness of the overcoat and the adjacent hole transport layer of the photoreceptor of this invention should be at least about 10 percent greater than the largest peak extending above the average plane of the outer surface of the receiving member. For example, where the largest asperity peak is about 80 micrometers, the combined thickness of the overcoating and the adjacent hole transport layer should be at least about 100 micrometers. By utilizing the highly conformable characteristics of the photoreceptor of this invention, substantially all of the toner image can be contacted with the adjacent surface of the image receiving member. This improved transfer provides images of lithographic quality. Lithographic images cannot tolerate image defects. Generally, increasing the thickness of a charge transport layer increases the transit time between imagewise exposure and development of a photoreceptor. Moreover, the addition of an overcoating increases the transit time even more. Thus, it is surprising the photoreceptor of this invention can have a thicker charge transport layer and an overcoating and still exhibit excellent short transit times. The thick charger transport layer utilized in the photoreceptor of this invention has a very high mobility one or two orders higher than other materials. Although the charge transport layer thickness of the photoreceptor of this invention is increased the hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Any suitable and conventional technique may be utilized to mix and thereafter apply the charge transport layer coating mixture to the underlying surface, e.g. charge generating layer. Typical applications techniques include spraying, dip coating, roll coating, wire wound rod coating, and the like. Drying of the deposited coating may be effected by any suitable conventional technique such as oven drying, infrared radiation drying, air drying and the like. The overcoat layer of this invention comprises a dihydroxy arylamine dissolved or molecularly dispersed in a crosslinked polyamide matrix.

The polysiloxyarylamine hole transporting material device herein described must have a protective overcoat. The polysiloxyarylamine material is very miscible with hydrocarbon fluids and hence, if used without an overcoat would dissolve in the hydrocarbon ink vehicle. These same hole transporting polymers if used in a dry xerographic application would become severely impacted with toner at the temperatures and pressures used in the image transfer zone. This toner would become part of the photoreceptor upon cooling, i.e. leaving the transfer zone, and render the photoreceptor useless. Therefore a protective overcoat is required.

The overcoat layer enabling this invention is formed from a crosslinkable coating composition comprising an alcohol soluble polyamide containing methoxy methyl groups attached to amide nitrogen atoms, a crosslinking catalyst and a dihydroxy arylamine.

Any suitable hole insulating film forming alcohol soluble polyamide polymer having methoxy methyl groups attached to the nitrogen atoms of amide groups in the polymer backbone prior to crosslinking may be employed in the overcoating of this invention. A preferred alcohol soluble polyamide polymer having methoxy methyl groups attached to the nitrogen atoms of amide groups in the polymer backbone prior to crosslinking is selected from the group consisting of materials represented by the following formulae A and B:

A

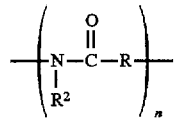

wherein:

n is a positive integer,

R is independently selected from the group consisting of alkylene, arylene or alkarylene units, between 1 and 99 percent of the $R^2$ sites are —H, and the remainder of the $R^2$ sites are $—CH_2—O—CH_3$ and

B

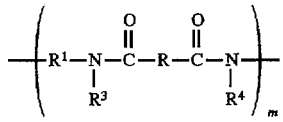

wherein:

m is a positive integer, $R_1$ and R are independently selected from the group consisting of alkylene, arylene or alkarylene units, between 1 and 99 percent of the $R^3$ and $R^4$ sites are —H, and the remainder of the $R^3$ and $R^4$ sites are $—CH_2—O—CH_3$.

Between about 1 percent and about 50 mole percent of the total number of repeat units of the nylon polymer should contain methoxy methyl groups attached to the nitrogen atoms of amide groups. These polyamides should form solid films if dried prior to crosslinking. The polyamide should also be soluble, prior to crosslinking, in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone. It should be noted that polyamides, such as Elvamides from DuPont de Nemours & Co., do not contain methoxy methyl groups attached to the nitrogen atoms of amide groups in the polymer backbone. The overcoating layer of this invention preferably comprises between about 50 percent by weight and about 98 percent by weight of the crosslinked film forming crosslinkable alcohol soluble polyamide polymer having methoxy methyl groups attached to the nitrogen atoms of amide groups in the polymer backbone, based on the total weight of the overcoating layer after crosslinking and drying. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof. Crosslinking is accomplished by heating in the presence of a catalyst. Any suitable catalyst may be employed. Typical catalysts include, for example, oxalic acid, p-toluenesulfonic acid, methanesulfonic acid, and the like and mixtures thereof. Catalysts that transform into a gaseous product during the crosslinking reaction are preferred because they escape the coating mixture and leave no residue that might adversely affect the electrical properties of the final overcoating. A typical gas forming catalyst is, for example, oxalic acid. The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific polyamide, catalyst, temperature and time used for the reaction. A typical crosslinking temperature used for Luckamide with oxalic acid as a catalyst is about 125° C. for 30 minutes. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the dihydroxy arylamine molecule as a fish is caught in a gill net. Prolonged attempts to extract the highly fluorescent dihydroxy arylamine hole transport molecule from the crosslinked overcoat, using long exposure to branched hydrocarbon solvents, revealed that the transport molecule is completely immobilized. Thus, when UV light is used to examine the extractant or the applicator pad no fluorescence is observed. The molecule is also locked into the overcoat by hydrogen bonding to amide sites on the polyamide.

The overcoating of this invention also includes a dihydroxy arylamine. Preferably, the dihydroxy arylamine is represented by the following formula:

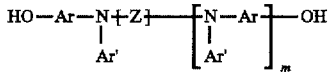

wherein:

m is 0 or 1,

Z is selected from the group consisting of:

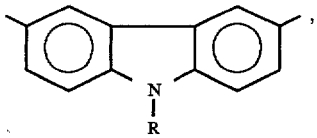

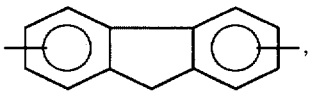

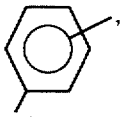

-continued

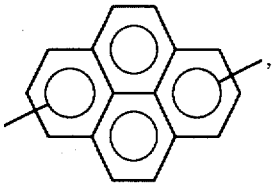

and

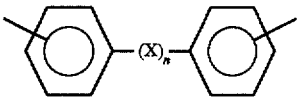

n is 0 or 1,

Ar is selected from the group consisting of:

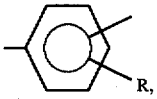

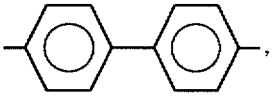

and

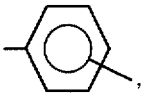

R is selected from the group consisting of $—CH_3$, $—C_2H_5$, $—C_3H_7$, and $—C_4H_9$, Ar' is selected from the group consisting of:

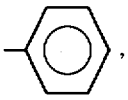

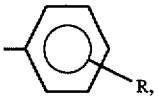

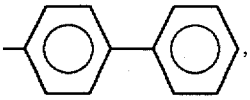

and

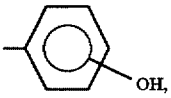

X is selected from the group consisting of:

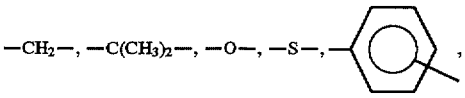

-continued

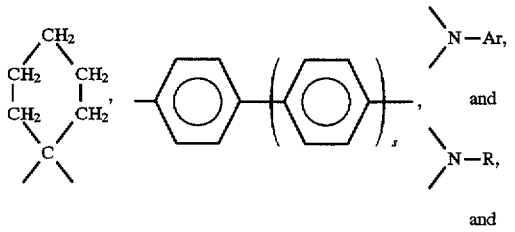

s is 0, 1 or 2.

This dihydroxy arylamine is described in detail in U.S. Pat. No. 4,871,634, the entire disclosure thereof being incorporated herein by reference.

The material selection of the cross linked overcoat is tuned for optimal surface, resiliency and wear properties to enable improved transfer and system properties. The thickness of the continuous overcoat layer selected depends upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

The electrophotographic member of the present invention containing the electrically active polymeric arylamine and crosslinked overcoating may be employed in any suitable and conventional electrophotographic imaging process which utilizes charging prior to image exposure to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the negatively charged areas or discharged areas on the imaging surface of the electrophotographic member of the present invention. More specifically, for positive development, charged toner particles of one polarity are attracted to the oppositely charged electrostatic areas of the imaging surface and for reversal development, charged toner particles are attracted to the discharged areas of the imaging surface. Where the transport layer of this invention is sandwiched between a photogenerating layer and a conductive surface, a positive polarity charge is normally applied prior to imagewise exposure to activating electromagnetic radiation. Where the photogenerating layer is sandwiched between a transport layer and a conductive surface, a negative polarity charge is normally applied prior to imagewise exposure to activating electromagnetic radiation. However, as described above, this latter configuration may also be used in an imaging system which utilizes the steps of forming a uniform negative charge on the overcoating so that an opposite positive uniform charge is formed in the injection layer, injecting the negative charge into the overcoating to form a negative charge in the overcoating layer adjacent the charge generating layer, forming a positive charge on the overcoating to neutralize the negative charge in the overcoating layer adjacent the charge generating layer and form a positive charge in the overcoating layer adjacent the charge generating layer, exposing the imaging member to activating radiation in image configuration to form an electrostatic latent image.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Transport Polymer Preparation Using N,N'-diphenyl-N,N'-bis(3-hydroxyphenyl)-(1-1'-biphenyl)-4,4'-diamine and Dimethyldichlorosilane A reaction vessel was constructed using a 500 ml. 3-necked Morton flask, a mechanical stirrer, a thermometer, a water condenser, a dropping burette and an electric heating mantle. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The feed was comprised of 2.8 grams of $(CH_3)_2SiCl_2$ (0.022 mole) and 7 cc of dry toluene.

Using external heating and vigorous agitation, the kettle contents was heated to approximately 50° to 60° C. At 58° C. the feed was added slowly and dropwise over the span of approximately 10 minutes. No external heat was used after the addition of the feed because the exothermic reaction maintained the temperature at approximately 62° C. After addition of the feed was complete, the reaction mixture was heated externally for approximately 15 minutes at approximately 60° C.

When the contents of the reaction vessel reached 30° C., 100 cc of water and 100 cc of toluene were added and the mixture was stirred well. The contents of the reaction vessel were then transferred to a separatory funnel where the bottom water layer was removed. Then 100 cc of 2 percent $HCl/H_2O$ was added to the funnel and the contents were shaken well. The water layer was removed and the step was repeated. Then 100 cc of 2 percent $NaHCO_3/H_2O$ was added and the contents were stirred. The water layer was removed and the step was repeated. The contents were washed twice with 100 cc portions of $H_2O$. The solvent/polymer layer was then removed, dried with $Na_2SO_4$, and filtered. Yield=10.0 grams.

EXAMPLE II

Transport Polymer Preparation Using N,N'-diphenyl-N,N'-bis(3-hydroxyphenyl)-(1-1'-biphenyl)-4,4'-diamine, Bis-Phenol A And Dimethyldichlorosilane A reaction vessel was constructed as in Example I. The reaction vessel was charged with 8.0 grams of dry $Et_3N$, 6.2 grams of N,N'-diphenyl-N,N'-bis(3-hydroxyphenyl)-(1-1'-biphenyl)-4,4'-diamine (0.012 mole), 50 cc of dry toluene, and 1.8 grams of bis-phenol A (about 0.008 mole). The feed was comprised of 2.8 grams of $(CH_3)_2SiCl_2$ (0.022 mole) and 7 cc of dry toluene.

Using external heating and vigorous agitation, the kettle contents was heated to approximately 60° C. At 55° C. the feed was added slowly and dropwise over the span of approximately 50 minutes. After addition of the feed was complete, the reaction mixture was heated externally for approximately 15 to 20 minutes at approximately 50° to 60° C. The contents were washed as in Example I to neutral pH. The contents were then dried over $Na_2SO_4$, and filtered.

The polymer solution obtained after filtration was recharged into the reaction vessel and 1.0 gram of $(CH_3)_2SiCl_2$ was added over the span of one hour. The contents were cooled and transferred to a separatory funnel where the contents were washed 3 times with 100 cc portions of $H_2O$, separated, dried over $Na_2SO_4$, and filtered. The filtered product was then precipitated into methanol and filtered. The solids were dried in a vacuum overnight at 50° C. Yield=5.5 grams.

EXAMPLE III

Transport Polymer Preparation Using N,N'-diphenyl-N,N'-bis(3-hydroxyphenyl)-(1-1'-biphenyl)-4,4'-diamine and 1,5-Dichlorohexamethyltrisiloxane and Dimethyldichlorosilane A reaction vessel was constructed as in Example I. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The first feed was comprised of 1.1 grams of 1,5-dichlorohexamethyltrisiloxane (about 0.004 moles) and 2.0 grams of dry toluene. The second feed was comprised of 2.3 grams (0.018 mole) of $Me_2SiCl_2$ and 7.0 grams of dry toluene.

Using external heating and vigorous agitation, the kettle contents were heated to approximately 75° C. At 75° C., the first feed was added slowly and dropwise over the span of approximately 10 minutes. After addition of the first feed was complete, the reaction mixture was heated externally for approximately 15 minutes at approximately 74° C. The reaction was then cooled to 60° C. and the second feed was added dropwise. After addition of the second feed was complete, the reaction mixture was heated externally for approximately 15 minutes at approximately 60° C. The reaction was cooled to room temperature where the contents were precipitated into 1500 ml of MeOH. A stringy elastomeric precipitate formed and was filtered through coarse glass frit. The flitrate was washed with MeOH and n-hexane. The solid was then dried at 45°–50° C. for 16 hours. The resulting solid was slightly turbid.

The dried solid was then resolvated in 75 cc of dry toluene. A celite filter aid was added and the solution was vacuum filtered through coarse glass frit. The flitrate was precipitated in 1500 ml n-heptane. The resulting polymer cake was washed with MeOH and vacuum dried for 3 hours at 50° C. The resulting solid was now transparent. Yield=9.5 grams. Mol. wt. data: $M_N$=38,323, $M_W$=115,971, disp. 3.03.

EXAMPLE IV

Transport Polymer Preparation Using N,N'-diphenyl-N,N'-bis(3-hydroxyphenyl)-(1-1'-biphenyl)-4,4'-diamine, Bis-Phenol A, 1,5-Dichlorohexamethyltrisiloxane and Dimethyldichlorosilane A reaction vessel was constructed as in Example I. The reaction vessel was charged with 8.3 grams of N,N'-diphenyl-N,N'-bis(3-hydroxyphenyl)-(1-1'-biphenyl)-4,4'-diamine (0.016 moles), 0.9 grams of bis-phenol A (BPA) (0.004 mole), 50 cc of dry toluene, and 5.0 grams of dry pyridine. The first feed was comprised of 1.4 grams of 1,5-dichlorohexamethyltrisiloxane (about 0.005 mole) and 2.0 grams of dry toluene. The second feed was comprised of 2.2 grams of $Me_2SiCl_2$ (0.017 mole) and 7.0 grams of dry toluene.

Using external heating and vigorous agitation, the kettle contents were heated to approximately 75° C. At 75° C., the first feed was added slowly and dropwise over the span of approximately 10 minutes. After addition of the first feed was complete, the reaction mixture was heated externally for approximately 15 minutes at approximately 75° C. The reaction was then cooled to 65° C. and the second feed was added dropwise. After 20 minutes, the addition of the second feed was complete and the reaction mixture was heated externally for approximately 15 minutes at approximately 65° C. The reaction was cooled to room temperature where the contents were vacuum filtered through a coarse glass frit. The flitrate was precipitated into 1000 cc of heptane and stirred for 1 hour. The solution was then filtered through a coarse glass frit and the solid was vacuum dried at 50° C. for three hours. Yield=9.2 grams. Mol. wt. data: $M_N$=21,339, $M_W$=45,140, disp.=2.12.

EXAMPLE V

Transport Polymer Preparation Using N,N'-diphenyl-N,N'-bis(3-hydroxyphenyl)-(1-1'-biphenyl)-4,4'-diamine, Dimethyldichlorosilane and Methyltrichlorosilane A reaction vessel was constructed as in Example I. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The first feed was comprised of 2.8 grams of $Me_2SiCl_2$, and 7.0 grams of dry toluene. The second feed was comprised of 0.05 grams of $MeSiCl_3$ in 1.0 grams of dry toluene.

The kettle charge was stirred at room temperature until dissolved. The feed was added while stirring vigorously. After addition of the feed was complete, the reaction mixture rose to 34° C. because it was exothermic. The reaction mixture was then heated externally for approximately 30 minutes at approximately 50° C. The reaction was then cooled to room temperature. The solution was filtered through a coarse glass frit and returned to the kettle. While stirring the mixture at 25° C. 0.05 gram of $MeSiCl_3$ in 1.0 gram of toluene was added. After 15 minutes the reaction mixture was then heated externally for approximately 15 minutes at approximately 50° C. The reaction was then cooled to room temperature and the solution was filtered through a coarse glass frit. The solution was then stirred for 1 hour in 1500 cc of n-hexane, washed with MeOH, and filtered through a coarse glass frit. The remaining solid was vacuum dried at 60° C. for 16 hours. Yield=10.2 grams. Mol. wt. data: $M_N$=53,866, $M_W$=239,958, disp.=4.45.

EXAMPLE VI

Transport Polymer Preparation Using N,N'-diphenyl-N,N'-bis(3-hydroxyphenyl)-(1-1'-biphenyl)-4,4'-diamine, Dimethyldichlorosilane and MethyltrichIorosilane A reaction vessel was constructed as in Example I. The reaction vessel was charged with 10.4 grams of N,N'- diphenyl-N,N'-bis(3-hydroxyphenyl)-(1-1'-biphenyl)-4,4'-diamine (0.02 mole), 50 cc of dry toluene, and 5.0 grams of dry pyridine. The feed was comprised of 2.7 grams of $Me_2SiCl_2$ (0.021 mole), 0.1 grams of $MeSiCl_3$ (0.0007 mole), and 8.0 grams of dry toluene.

Using external heating and vigorous agitation, the kettle contents were heated to approximately 50° to 60° C. At 50° C., the feed was added slowly and dropwise over the span of approximately 20 minutes. After addition of the feed was complete, the reaction mixture was heated externally for approximately 60 minutes at approximately 55° C. and was stirred vigorously.

The reaction was cooled to room temperature. The solution was filtered through a coarse glass frit and returned to the kettle. The solution was then stirred for 1 hour in 1500 cc of n-hexane, washed with MeOH, and filtered through a coarse glass frit. The remaining solid was vacuum dried at 50°–55° C. overnight. Yield=9.8 grams. Mol. wt. data: $M_N$=13,664, $M_W$=51,377, disp.=3.76.

EXAMPLE VII

Transport Polymer Preparation Using N,N'-diphenyl-N,N'-bis(3-hydroxyphenyl)-(1-1'-biphenyl)-4,4'-diamine, 1,5-Dichlorohexamethyltrisiloxane and Methyltrichlorosilane A reaction vessel was constructed as in Example I. The reaction vessel was charged with 10.4 grams of N,N'-diphenyl-N,N'-bis(3-hydroxyphenyl)-(1-1'-biphenyl)-4,4'-diamine (0.02 moles), 50 cc of dry toluene, and 5.0 grams of dry pyridine. The feed was comprised of 5.5 grams of 1,5-dichlorohexamethyltrisiloxane (0.02 mole) and 5.0 grams of dry toluene.

Using external heating and vigorous agitation, the kettle contents were heated to approximately 75° C. At 75° C., the feed was added slowly and dropwise over the span of approximately 35 minutes. After addition of the feed was complete, the reaction mixture was heated externally for approximately 60 minutes at approximately 70° C. and was stirred vigorously.

The reaction was then cooled to room temperature. At 25° C., 0.05 grams of $MeSiCl_3$ was added and heated to 50° C. After 15 minutes an additional 0.05 gram of $MeSiCl_3$ was added and heated at 50° C. for 15 minutes. The solution was cooled to room temperature, filtered through a coarse glass frit and precipitated in 1500 cc of methanol. The solution was vacuum filtered through a coarse glass frit. The remaining solid was vacuum dried at 50° C. for 3.0 hours. Yield=9.6 grams. Mol. wt. data: $M_N$=22,268, $M_W$=64,435, disp.=2.89.

EXAMPLE VIII

Transport Polymer Preparation Using N,N'-diphenyl-N,N'-bis(3-hydroxyphenyl)-(1-1'-biphenyl)-4,4'-diamine and 1,7-Dichlorooctamethyltetrasilxane A reaction vessel was constructed as in Example I. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The feed was comprised of 7.0 grams of 1,7-dichlorooctamethyltetrasiloxane (0.02 mole) and 7.0 grams of dry toluene.

Using external heating and vigorous agitation, the kettle contents were heated to approximately 75° C. At 75° C., the feed was added slowly and dropwise over the span of approximately 35 minutes. The contents then were maintained at 75° C. for one hour. The reaction was then cooled to 50° C., and 0.1 gram of $MeSiCl_3$ in 1.0 gram of toluene was added and heated to 50°–55° C. and stirred for 15 minutes.

The contents were cooled to room temperature, filtered and precipitated into 1500 cc methanol. The precipitate was then vacuum overnight at 55° C. Yield=10.0grams. Mol. wt. data: $M_N$=30,156, $M_W$=86,774, disp.=2.88.

EXAMPLE IX

Transport Polymer Preparation Using N,N'-diphenyl-N,N'-bis(3-hydroxyphenyl)-(1-1'-biphenyl)-4,4'-diamine and 1,1,4,4-Tetramethyl-1,4-dichlorodisilethylene A reaction vessel was constructed as in Example I. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The feed was comprised of 4.3 grams of 1,1,4,4-tetramethyl-1,4-dichlorodisilethylene (0.02 mole) and 7.0 grams of dry toluene.

Using external heating and vigorous agitation, the kettle contents were heated to approximately 75° C. At 75° C., the feed was added slowly and dropwise over the span of approximately 30 minutes. The contents then were maintained at 75° C. for one hour. The reaction was cooled to 50° C., and 0.1 gram of $MeSiCl_3$ in 1.0 gram of toluene was added and heated to 50°–55° C. and stirred for 15 minutes.

The contents were cooled to room temperature, filtered and precipitated into 1500 cc MeOH. The precipitate was then vacuum dried overnight at 55° C. Yield=11.5 grams. Mol. wt. data: $M_N$=6,723, $M_W$=30,139, disp.=4.48.

EXAMPLE X

Transport Polymer Preparation Using N,N'-diphenyl-N,N'-bis(3-hydroxyphenyl)-(1-1'-biphenyl)-4,4'-diamine and 1,7-Dichlorooctamethyltetrasiloxane and Phenylmethyldichlorosilane A reaction vessel was constructed as in example I. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The feed was comprised of 5.6 grams of 1,7-dichlorooctamethyltetrasiloxane (0.016 mole), 0.8 gram of phenylmethyldichlorosilane (0.004 moles) and 7.0 grams of dry toluene.

Using external heating and vigorous agitation, the kettle contents were heated to approximately 75° C. At 75° C., the feed was added slowly and dropwise over the span of approximately 40 minutes. The contents then were maintained at 75° C. for one hour. The reaction was then cooled to about 50°–55° C. At 55° C., 0.1 gram of $MeSiCl_3$ in 1.0 gram of toluene was added and heated to 50°–55° C. and stirred for 15 minutes.

The contents were cooled to room temperature, filtered through a coarse glass frit and precipitated into 1500 cc MeOH. The precipitate was then vacuum dried overnight at 50° C. Yield=13.2 grams.

EXAMPLE XI

Transport Polymer Preparation Using N,N'-diphenyl-N,N'-bis(3-hydroxyphenyl)-(1-1'-biphenyl)-4,4'-diamine and 1,7-Dichlorooctamethyltetrasiloxane and Dimethyldichlorosilane A reaction vessel was constructed as in Example I. The reaction vessel was charged with 10.4 grams of N,N'- diphenyl-N,N'-bis(3-hydroxyphenyl)-(1,1'-biphenyl)-4,4'-diamine (0.02 mole), 50 cc of dry toluene, and 5.0 grams of dry pyridine. The first feed was comprised of 3.5 grams of 1,7-dichlorooctamethyltetrasiloxane (about 0.01 mole) and 7.0 grams of dry toluene. The second feed was comprised of 1.6 grams of dimethyldichlorosilane (0.012 moles) and 3.0 grams of dry toluene.

Using external heating and vigorous agitation, the kettle contents were heated to approximately 75° C. At 75° C., the first feed was added slowly and dropwise over the span of approximately 20 minutes. The contents then were maintained at 75° C. for 20 minutes. The reaction was then cooled to 50° C. At 50° C., the second feed was added slowly and dropwise over the span of approximately 10 minutes. The contents then were maintained at 50° C. for 15 minutes. The contents were cooled to room temperature, filtered through #2 Whatman paper, and precipitated into 1500 cc MeOH. The precipitate was then vacuum dried at 50° C. for three hours. Yield=10.6 grams. Mol. wt. data: $M_N$=23,988, $M_W$=64,439, disp.=2.69.

EXAMPLE XII

Transport Polymer Preparation Using N,N'-diphenyl-N,N'-bis(3-hydroxyphenyl)-(1-1'-biphenyl)-4,4'-diamine and 1,7-Dichlorooctamethyltetrasiloxane and Dimethyldichlorosilane A reaction vessel was constructed as in Example I. The reaction vessel was charged with 10.4 grams of N,N'-diphenyl-N,N'-bis(3-hydroxyphenyl)-(1-1'-biphenyl)-4,4'-diamine (0.02 mole), 50 cc of dry toluene, and 5.0 grams of dry pyridine. The first feed was comprised of 3.5 grams of 1,7-dichlorooctamethyltetrasiloxane (0.01 mole) and 7.0 grams of dry toluene. The second feed was comprised of 1.8 grams of dimethyldichlorosilane (0.014 mole) and 3.0 grams of dry toluene.

Using external heating and vigorous agitation, the kettle contents were heated to approximately 75° C. At 75° C., the first feed was added slowly and dropwise over the span of approximately 25 minutes. The contents then were maintained at 75° C. for 15 minutes. The reaction was then cooled to 50° C. At 50° C., the second feed was added slowly and dropwise over the span of approximately 20 minutes. The contents were maintained at 50° C. for 15 minutes.

The contents were cooled to room temperature, filtered through #2 Whatman paper, and precipitated into 1500 cc MeOH. The precipitate solution was stirred for one hour and then filtered through a coarse glass frit. The polymer cake was washed with MeOH several times. The polymer cake was then vacuum dried at 50° C. for 16 hours. Yield=12.3 grams. Mol. wt. data: $M_N$: 34,482, $M_W$=78,131, disp.=2.27.

EXAMPLE XIII

Two photoreceptors are prepared by forming coatings using conventional techniques on a substrate comprising a vacuum deposited titanium layer on a flexible polyethylene terephthalate film having a thickness of 3 mil (76.2 micrometers). The first coating is a siloxane barrier layer formed from hydrolyzed gamma aminopropyltriethoxysilane having a thickness of 0.005 micrometer (50 Angstroms). This layer is coated from a mixture of 3-aminopropyltriethoxysilane (available from PCR Research Chemicals of Florida) in ethanol in a 1:50 volume ratio. The coating is applied to a wet thickness of 0.5 mil by a multiple clearance film applicator. The coating is then allowed to dry for 5 minutes at room temperature, followed by curing for 10 minutes at 110 degree centigrade in a forced air oven. The next applied coating is an adhesive layer of polyester resin (49,000, available from E. I. dupont de Nemours & Co.) having a thickness of 0.005 micron (50 Angstroms) and was coated from a mixture of 0.5 gram of 49,000 polyester resin dissolved in 70 grams of tetrahydrofuran and 29.5 grams of cyclohexanone. The coating is applied by a 0.5 mil bar and cured in a forced air oven for 10 minutes. This adhesive interface layer is thereafter coated with a photogenerating layer (CGL) containing 40 percent by volume hydroxygallium phthalocyanine and 60 percent by volume copolymer polystyrene (82 percent)/poly-4-vinyl pyridine (18 percent) with Mw of 11,000. This photogenerating coating mixture is prepared by introducing 1.5 grams polystyrene/poly-4-vinyl pyridine and 42 ml of toluene into a 4 oz. amber bottle. To this solution is added 1.33 grams of hydroxygallium phthalocyanine and 300 grams of ⅛ inch diameter stainless steel shots. This mixture is then placed on a ball mill for 20 hours. The resulting slurry is thereafter applied to the adhesive interface with a Bird applicator to form a layer having a wet thickness of 0.25 mil. The layer is dried at 135° C. for 5 minutes in a forced air oven to form a dry thickness photogenerating layer having a thickness of 0.4 micrometer.

The generator layer is then coated with charge transport layers containing the polymer of Formula 1 above where n=2. 25 grams of the polymer is dissolved in 75 grams of toluene to yield a 25 percent by weight charge transport layer solution. The transport layer is coated using a #75 Meyer rod and the resulting film is dried at 125° C. for 10 minutes in a forced air oven. To get the desired thickness of 50 microns, a second coating of transport layer is coated on top of the dried first layer using a #75 Meyer rod. The device is once again dried at 125° C. for 10 minutes in a forced air oven.

EXAMPLE XIV

One of two photoreceptor devices is then overcoated with a crosslinked overcoat as follows. Prior to application of the overcoat layer, the photoreceptor device is primed by applying 0.1 percent by weight of Elvacite 2008 in 90:10 weight ratio of isopropyl alcohol and water using a #3 Meyer rod. This prime coating is air dried in a hood. The overcoat layer is prepared by mixing 10 grams of a 10 percent by weight solution of polyamide containing methoxymethyl groups (Luckamide 5003, available from Dai Nippon Ink) in a 90:10 weight ratio solvent of methanol and n-propanol and 10 grams of N,N'-diphenyl-N,N'-bis (3-hydroxyphenol)-[1,1'-biphenyl]-4,4"-diamine (a dihydroxy arylamine) in a roll mill for 2 hours. Immediately prior to application of the overcoat layer mixture, 0.1 gram of oxalic acid is added and the resulting mixture is roll milled briefly to assure dissolution. This coating solution is applied to the primed photoreceptor using a #20 Meyer rod. This overcoat layer is air dried in a hood for 30 minutes. The air dried film is then dried in a forced air oven at 125° C. for 30 minutes. The overcoat layer thickness is approximately 3 micrometers. The oxalic acid caused crosslinking of the methoxymethyl groups of the polyamide to yield a tough, abrasion resistant, hydrocarbon resistant top surface.

EXAMPLE XV

A semitransparent gold electrode is deposited on a portion of the photoreceptor device of Example XIV in a vacuum chamber. This sandwich assembly is connected in an electrical circuit containing a power supply and a current measuring resistance. The transit time of the carriers is determined by the time of flight technique. This is accomplished by biasing the gold electrode negative and exposing the device to a short flash of light. Holes photogenerated in the generator layer are injected into and transit through the transport layer. The current due to the transit of a sheet of holes is time resolved and displayed on an oscilloscope. The current pulse consists of a flat portion followed by a rapid decrease. The flat portion is due to the transit of the sheet of holes through the transport layer. The rapid drop of current signals the arrival of the holes at the gold electrode. From the transit time, the velocity of the carriers is calculated by the relation:velocity=transport layer thickness divided by the transit time. The hole mobility is related to the velocity by the relation:

velocity=(mobility)×(electric field).

The mobility of this transport layer is determined to be $2\times10^{-4}$ $cm^2$/volt sec at an applied electric field of $2\times10^5$ V/cm. This value is an order of magnitude larger than the transport layers employing the best of the charge transporting small molecules dispersed in polycarbonate. The transit time at a voltage of 100 volts is 20 milliseconds much shorter than the time between the exposure and development stations even at very high surface speeds. This polymer can be employed in devices with transport layer thickness in excess of 100 microns. This mobility value suggests very good transport.

EXAMPLE XVI

The flexible photoreceptor sheet prepared as described in Examples XIII and XIV are tested for their xerographic sensitivity and cyclic stability. The sheets are mounted on a cylindrical aluminum drum substrate which is rotated on a shaft. The devices are charged by a corotron mounted along the periphery of the drum. The surface potential is measured as a function of time by capacitively coupled voltage probes placed at different locations around the shaft. The probes are calibrated by applying known potentials to the drum substrate. Each photoreceptor sheet on the drum is exposed by a light source located at a position near the drum downstream from the corotron. As the drum is rotated, the initial (pre exposure) charging potential was measured by voltage probe 1. Further rotation leads to the exposure station, where the photoreceptor device is exposed to monochromatic radiation of known intensity. The device is erased by a light source located at a position upstream of charging. The measurements made include charging of the photoconductor device in a constant current or voltage mode. The device is charged to a negative polarity corona. As the drum is rotated, the initial charging potential is measured by voltage probe 1. Further rotation leads to the exposure station, where the photoreceptor device is exposed to monochromatic radiation of known intensity. The surface potential after exposure is measured by voltage probes 2 and 3. The device is finally exposed to an erase lamp of appropriate intensity and any residual potential is measured by voltage probe 4. The process is repeated with the magnitude of the exposure automatically changed during the next cycle. The photodischarge characteristics is obtained by plotting the potentials at voltage probes 2 and 3 as a function of light exposure. The charge acceptance and dark decay are also measured in the scanner. The PhotoInduced Discharge characteristics (PIDC) of the device of Example XIV is similar to the device without the overcoat (Example XIII) and the cyclic plot shows no cycle-up of residual as a result of the overcoat.

EXAMPLE XVII

A turntable device is fitted with a polyurethane blade configured in the doctor mode. The blade is adjustable for reproducible setting of the nip gap. A metered dispenser is used to feed specific quantities of a single component developer from the Xerox 5012 electrophotographic imaging machine. This developer acts as the abrading agent. This device is employed to test wear of materials by abrasion. Wear is calculated in nanometers per kilocycles rotation (nm/Kcs). Reproducibility of calibration standards is about ±2nm/Kc. Sample wear is measured by an interference measuring device, known as the Otsuka gauge. The device of Example XIII is compared to the overcoated device of Example XIV. The wear rate of the device from Example XIII is 150 nm/Kc and the wear rate of the device in Example XIV is 6 nm/Kc, a more than twentyfive time improvement.

EXAMPLE XVIII

The photoreceptors of Example XIII and XIV are contacted with gauze pads soaked with Isopar M, a $C_{15}$ branched hydrocarbon useful in liquid ink development xerography. When the pads which contacted the unovercoated photoreceptor of Example XIII, the transport layer of the unovercoated photoreceptor begins to dissolve and the uncrosslinked overcoated photoreceptor of Example XIV remains intact, indicating that the crosslinked sample is resistant to Isopar. Also there is no extraction of hydroxy arylamine molecule from the overcoat by the Isopar. This is determined by exposing the pad that has been in contact with the overcoated device of Example XIV to an ultraviolet lamp. There is no evidence of flourescence, the telltale fluorescence (characteristic of the transport molecule), indicating that the crosslinked sample is resistant to Isopar extraction.

EXAMPLE XIX

A photoreceptor device of Example XIII and a device of Example XIV are tested for ink transfer efficiency. The test consists of placing an ink image on the photoreceptor device and then running it, along with paper to receive the image, through a nip created by two rollers. The rollers apply heat and pressure squeezing the photoreceptor device and paper together causing the image to transfer if the experimental device is functional. The roller backing the photoreceptor is heated to 80 degrees C and a force of 200 lbs/sq. in is applied in the nip. The device of Example XIII possessing no overcoat is severely damaged and the image does not transfer. The device of Example of XIV having an overcoat transfers an image.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A flexible electrophotographic imaging member said imaging member comprising a supporting substrate coated with a resilient combination of at least one photoconductive layer and an overcoating layer, said at least one photoconductive layer comprising a charge generating material and a hole transporting arylamine siloxane polymer and said overcoating comprising a crosslinked polyamide doped with a dihydroxy arylamine.

2. An electrophotographic imaging member according to claim 1 wherein said arylamine siloxane polymer is represented by the formula:

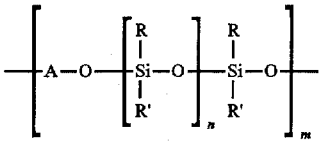

wherein:

A is a tertiary arylamine moiety,

R is a substituted or unsubstituted alkyl, alkenyl or aryl group,

R' is a substituted or unsubstituted alkyl, alkenyl or aryl group, m is an integer from about 5 to about 5,000, and n is an integer from 0 to 6.

3. An electrophotographic imaging member according to claim 1 wherein said polyamide is selected from the group consisting of polymer A and polymer B represented by the following formulae:

A

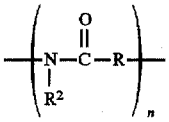

wherein:

n is a positive integer,

R is independently selected from the group consisting of alkylene, arylene or alkarylene units, between 1 and 99 percent of the $R^2$ sites are —H, and the remainder of the $R^2$ sites are —$CH_2$—O—$CH_3$ and

B

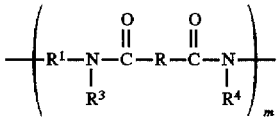

wherein:

m is a positive integer, $R^1$ and R are independently selected from the group consisting of alkylene, arylene or alkarylene units, between 1 and 99 percent of the $R^3$ and $R^4$ sites are —H, and the remainder of the $R^3$ and $R^4$ sites are —$CH_2$—O—$CH_3$.

4. An electrophotographic imaging member according to claim 1 wherein said dihydroxy amine is represented by the following formula:

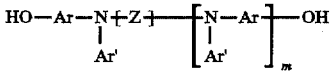

wherein:

m is 0 or 1,

Z is selected from the group consisting of:

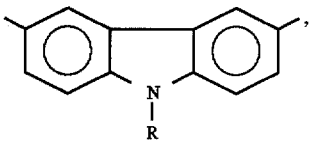

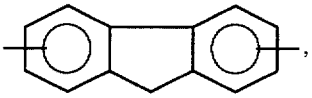

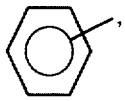

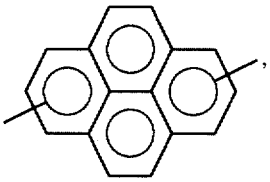

and

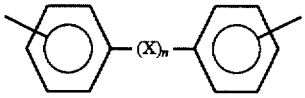

n is 0 or 1,

Ar is selected from the group consisting of:

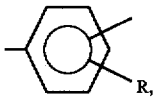

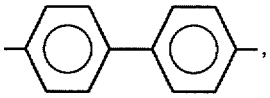

and

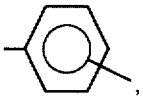

R is selected from the group consisting of —$CH_3$, —$C_2H_5$, —$C_3H_7$, and —$C_4H_9$, Ar' is selected from the group consisting of:

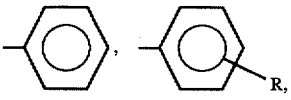

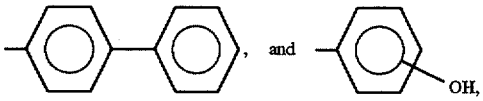

X is selected from the group consisting of:

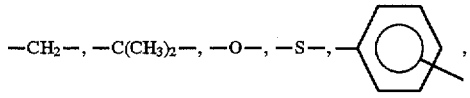

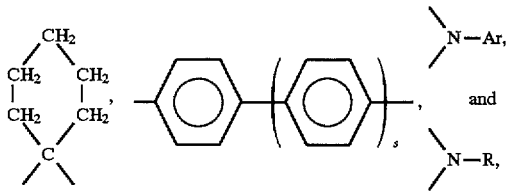

and s is 0, 1 or 2.

5. An electrophotographic imaging member according to claim 1 wherein said supporting substrate comprises polyethylene terephthalate.

6. A flexible electrophotographic imaging member comprising a supporting substrate coated with a resilient combination of a charge generating layer comprising a charge generating material, a charge transport layer comprising a hole transporting arylamine siloxane polymer, and an overcoating comprising a crosslinked polyamide doped with a dihydroxy arylamine.

7. An electrophotographic imaging member according to claim 6 wherein said transport layer is substantially free of internal tensile force.

8. An electrophotographic imaging member according to claim 6 wherein said transport layer has a thickness between about 20 micrometers and about 100 micrometers.

9. An electrophotographic imaging member according to claim 1 wherein said siloxane polymer has a weight average molecular weight of at least about 20,000.

10. An electrophotographic imaging member according to claim 1 wherein said substrate has two sides, one side bearing said at least one photoconductive layer and an overcoating layer and the opposite side being free of an anticurl backing layer.

11. An electrophotographic imaging member according to claim 1 wherein said substrate is a flexible web.

12. An electrophotographic imaging member according to claim 1 wherein said substrate is a rigid drum.

13. An electrophotographic imaging process comprising providing a flexible electrophotographic imaging member free of an anticurl backing layer, said imaging member comprising a supporting substrate coated with a resilient combination of at least one photoconductive layer and an overcoating layer, said at least one photoconductive layer comprising a charge generating material and a hole transporting arylamine siloxane polymer and said overcoating comprising a crosslinked polyamide doped with a dihydroxy arylamine, forming an electrostatic latent image on said imaging member, depositing toner particles on said imaging member in conformance with said latent image to form a toner image, and transferring said toner image to a receiving member.

14. An electrophotographic imaging process according to claim 13 wherein said toner particles have a Tg of between about 35° C. and about 95° C.

15. An electrophotographic imaging process according to claim 13 wherein said at least one photoconductive layer comprises a charge generating layer and a charge transport layer wherein said charge generating layer comprises said charge generating material and said charge transport layer comprises said hole transporting arylamine siloxane polymer.

16. An electrophotographic imaging process according to claim 15 wherein said receiving member has an outer surface having asperities at least as large as between about 20 micrometers and about 80 micrometers and said transport layer has a thickness of at as large as about 100 micrometers.

17. An electrophotographic imaging process according to claim 13 wherein said toner particles are deposited on said imaging member from a liquid developer containing a hydrocarbon carrier liquid.

* * * * *